US005077871A

United States Patent [19]

Baumann et al.

[11] Patent Number: 5,077,871

[45] Date of Patent: Jan. 7, 1992

[54] SAFETY BELT FASTENER

[75] Inventors: Jan Baumann, Uetersen; Andreas Bock, Notorf, both of Fed. Rep. of Germany

[73] Assignee: Autoflug GmbH & Co. Fahrzeugtechnik, Rellingen, Fed. Rep. of Germany

[21] Appl. No.: 647,429

[22] Filed: Jan. 28, 1991

[30] Foreign Application Priority Data

Jan. 28, 1990 [DE] Fed. Rep. of Germany ..... 4002463

[51] Int. Cl.[5] ..... A44B 11/25

[52] U.S. Cl. ..... 24/641; 24/637

[58] Field of Search ..... 24/641, 640, 642, 647, 24/639, 656, 652

[56] References Cited

U.S. PATENT DOCUMENTS

| | | | |
|---|---|---|---|
| 4,004,115 | 1/1977 | Esner | 24/641 |
| 4,353,151 | 10/1982 | Ennerdal | 24/641 |
| 4,358,879 | 11/1982 | Magyar | 24/641 |
| 4,527,317 | 7/1985 | Strasrewski et al. | 24/641 |
| 4,611,369 | 9/1986 | Wier | 24/642 |

FOREIGN PATENT DOCUMENTS

| | | | |
|---|---|---|---|
| 2807575 | 8/1979 | Fed. Rep. of Germany | 24/641 |

*Primary Examiner*—Victor N. Sakran

*Attorney, Agent, or Firm*—Robert W. Becker & Associates

[57] ABSTRACT

With a safety belt fastener for the take-up and latching of an insertion tongue having a housing and an insertion path for the insertion tongue, the insertion path being arranged in the housing and containing an ejector under spring action, having a latch guided in the fastener and cooperating with the tongue recess in the case of latching, the latch holding the insertion tongue in an associated recess of the fastener, and a spring-loaded shift key, guided at right angles to the movement plane of the latch, for the lifting of the latching device, the movement of which is composed of an unlatching stroke and a preceding idle stroke, simple anti-shock means are realized by providing in addition to the shift-key spring a further additional spring supported between a fastener part and the shift key, aligned in its spring force to oppose the insertion direction of the shift key and only active during the idle stroke of the shift key.

12 Claims, 3 Drawing Sheets

SAFETY BELT FASTENER

BACKGROUND OF THE INVENTION

The invention concerns a safety belt fastener, for receiving and latching an insertion tongue, having a housing and an insertion path for the insertion tongue, the insertion path being arranged in the housing and containing a spring-based ejector having a latch means guided in the fastener for cooperation with a recess in the tongue to achieve latching, the latch means then holding the insertion tongue in an associated recess of the fastener, and a spring-loaded shift key guided at right angles to the movement plane of the latch means for lifting the latch means, the movement of this shift key being composed of an unlatching stroke preceded by an idle stroke.

Safety belt fasteners generally have the particular problem that the latch opens automatically under extreme conditions, especially under the action of acceleration forces acting on the fastener in the individual case, if the operating parts of securing parts actuating the latch, or the latch itself, move out of their latching position due to their mass inertia and thus finally the latch is released from its latching position A shift-key fastener of this type is known from DE-OS 28 28 049, in which the latch is moveable perpendicularly to the insertion tongue and which, when latched, is secured by a projection, arranged on the shift key travelling over the latch, against acceleration forces acting in the plane of the travel movement of the latch. However, acceleration forces can act on the fastener in the action plane of the shift key for actuating the latch, for example if the fastener is moved in its longitudinal direction as a result of a tightening of the safety belt when an accident occurs. If the housing of the fastener is suddenly stopped at the end of such tightening movement, the shift key continues to move in the tightening direction due to its mass inertia, with the result that the shift key and the fastener body experience a movement relative to one another during which the shift key is inserted into the fastener body and as a result carries out an opening movement to release the latch to effect unlatching.

In a safety belt fastener as described in DE-OS 35 33 684, securing of the shift key in the case of acceleration takes place through association of an additional mass which compensates for the acceleration forces and mass forces acting on the shift key. Such an additionally applied additional mass, however, is costly and causes a complicated fastener construction as well as a correspondingly complicated fastener mechanism when opening and closing the fastener.

The object underlying the invention therefore is to improve a shift-key fastener of the type named at the beginning in such a way that its anti-shock means against acceleration forces acting in the action direction of the shift key are simplified.

SUMMARY OF THE INVENTION

The safety belt fastener of the present invention is primarily characterized by a resilient means being provided in addition to a spring of the shift key, whereby the resilient means is disposed between a part of the safety belt fastener and the shift key and is resisting movement of the shift key in the insertion direction only during the idle stroke of the shift key.

In more detail, the invention provides that in addition to a shift-key spring constituting a first resilient means, there is provided a further additional spring constituting a second resilient means, this additional spring being supported between a fastener part and the shift key, the spring force of the additional spring being aligned against the insertion direction of the shift key and only being active in this sense during an idle stroke of the shift key. In this way the arrangement of an additional mass for the compensation of the acceleration forces acting on the shift key can be dispensed with in an advantageous manner. Rather the invention utilizes the idea of applying an additional spring force aligned against the insertion direction of the shift key during the construction-conditioned idle stroke of the shift key, with the result that the shift key with acceleration acting on it must first of all overcome the force of this additional spring before the unlatching stroke of the shift key, that is its further insertion movement, begins. So that the forces, necessary for the opening of the safety belt, for the insertion movement of the shift key by means of the entire shift-key stroke, therefore including the unlatching stroke, are not increased by the additional spring action of the additional spring, it is provided according to the invention that the spring action of the additional spring is only active during the idle stroke of the shift key and ceases with entry of the shift key into the unlatching stroke.

According to a preferred exemplary embodiment of the invention a prestressing, directed against the insertion direction for the shift key, is supplied to the additional spring, so that from the beginning of the insertion movement a corresponding spring resistance predominates. The force of the additional spring in this connection is to be measured in such a way that the entire level of the insertion force necessary for the unlatching of the fastener is not exceeded.

For the realization of the principle according to the invention that with entry of the shift key into its unlatching stroke the action of the additional springs ceases, it is provided according to exemplary embodiments of the invention that the development of the respectively associated abutments for the additional spring in terms of form on the shift key on the one hand and/or on the fastener on the other hand is undertaken in such a way that once an established insertion section for the shift key is reached, i.e. at the beginning of the unlatching stroke, the spring support is lifted so that during the unlatching stroke the additional spring no longer applies any spring force on to the shift key in the sense to restrain unlatching motion thereof, but rather become active again only after reaching the starting position of the shift key in its position before the insertion movement has begun.

In this respect, according to a first exemplary embodiment of the invention the additional spring is constructed as a leaf spring that is connected to the housing of the fastener and rests with its free end loosely against an abutment constructed on the shift key, whereby during the shift-key stroke it slides away over the abutment and the support path supplied by the abutment corresponds to the idle stroke of the shift key so that at the end of the idle stroke the loose end of the leaf spring loses its engagement on the shift key and the additional spring is therefore inactive in the sense to restrain unlatching movement of the shift key during the unlatching stroke.

An alternative embodiment to this provides in a similar manner that a spring is arranged on the shift key and this spring is allowed to be supported on a abutment of the housing, the spring being provided with a curvature formed in the insertion direction of the shift key and with prestressing, so that during the relative movement between the shift key and the fastener housing the curvature of the shift key is intensified and the latter with deformation is inserted into an intermediate space formed between the shift key and the fastener, whereby in this position it is no longer in a position to supply any more spring forces on to the shift key in the sense to restrain unlatching movement thereof.

Two further exemplary embodiments of the invention proceed on the assumption that the support of the additional spring can also be realized on the latch means of the fastener, and in this respect a leaf spring is held centrally on the latch means at right angles to the insertion direction of the shift key, which is supported with its free ends on both sides on associated abutments, also enclosing a channel between them, of the shift key constructed in this respect in a U-shaped manner. During the insertion movement of the shift key the spring held centrally on the latch means is bent together between the projections until the additional spring can be inserted into the channel of the shift key constructed between the abutments, so that a support of the spring and spring action emanating from this in the sense to oppose unlatching movement is no longer given.

Alternatively, it can be provided that the additional spring is provided in the form of two spring portions bent inwardly towards one another which are molded on the shift key, the spring portions enclosing between them an abutment arranged on the latch means and resting against this, whereby during the relative movement of the shift key they slide on the abutment of the latch means until the lifting of the support of the springs on the latch means.

In order to increase the sliding ability of the respectively free ends of the additional springs provided in various forms on the abutments of the associated fastener parts, it is advantageous to construct these free ends of the springs in rounded, i.e. spherical, form.

BRIEF DESCRIPTION OF THE DRAWINGS

For a better understanding of the invention and to show how the same may be carried into effect, reference will now be made, by way of example, to the accompanying drawings, in which.

DESCRIPTION OF PREFERRED EMBODIMENTS

Figure 1:
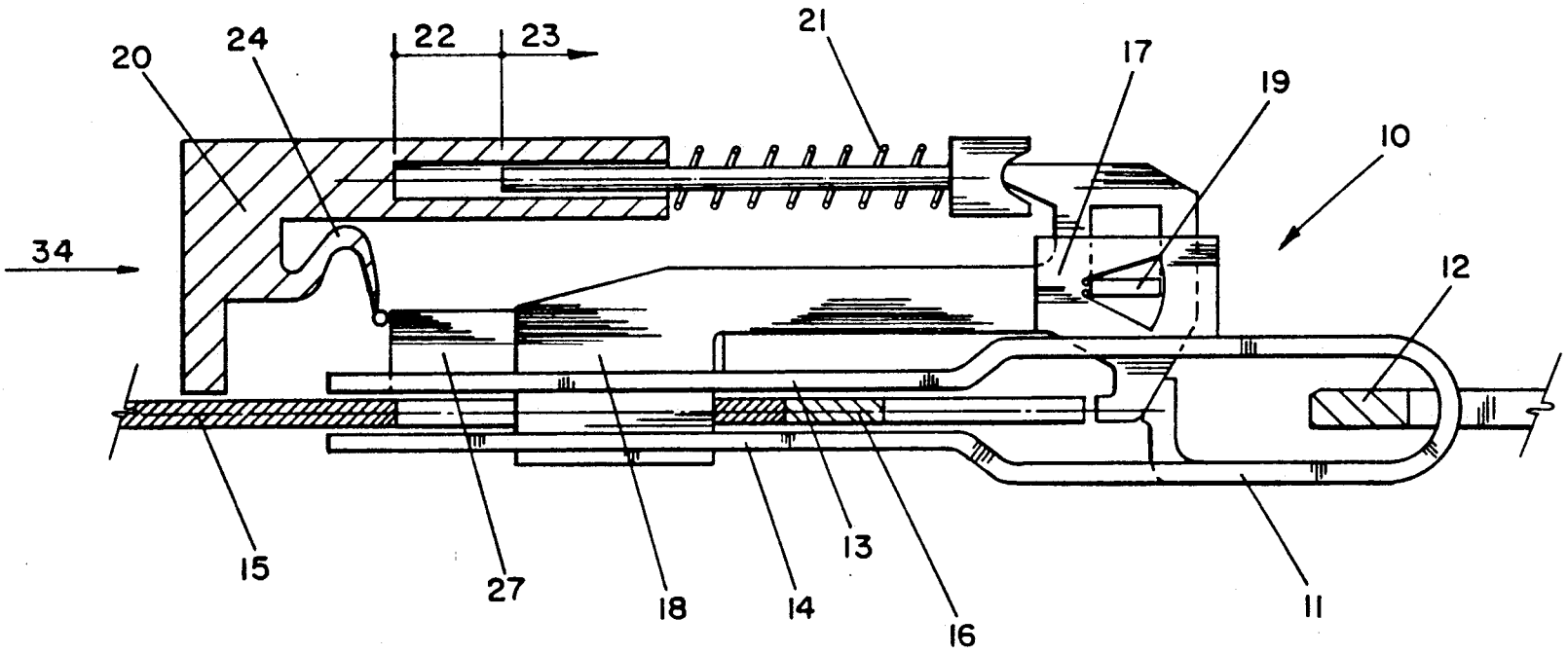
FIG. 1 is a side view, partly in section, of a safety belt fastener.

Referring first to FIG. 1, the safety belt fastener 10 consists of a one-part lock plate 11 which, from a bent round part in the region of its fastening on an anchoring part 12, has two equally long limbs 13, 14, between which an insertion or lock tongue 15 can be inserted against the action of an ejector 16. In two lugs 17 bent up in the rear region of the lock plate 11 a latch means in the form of a latch 18 is mounted perpendicularly to the insertion plane for the insertion or lock tongue 15 in a rotatable manner at a hinge 19, the constructional formation of this latching mechanism not being the subject of the invention. A shift key 20 guided parallel to the lock plate 11 in the safety belt fastener 10, is held, by a pressure spring 21, in its front position. During insertion movement in the direction towards the anchoring part 12 the shift key 20 actuates the latch 18 in the sense of an opening movement with release of the insertion or lock tongue 15.

In this connection, during its insertion movement in the direction towards the anchoring part 12 the shift key 20 passes through an idle stroke 22, whereafter the shift key is inserted into the fastener 10 only against the action of the pressure spring 21 loading it, whereby the loading of the latch 18 in the sense of an unlatching movement for the insertion or lock tongue 15 results. This unlatching stroke is denoted as 23.

In FIGS. 2 to 5 in the various movement states of the shift key 20, the realization of anti-shock means is described in various embodiments. In this connection, in each of FIGS. 2*a*, 3*a*, 4*a* and 5*a* the starting position of the shift key 20 is shown, in each of FIGS. 2*b*, 3*b*, 4*b* and 5*b* the behavior during the idle stroke and in each of FIGS. 2*c*, 3*c*, 4*c* and 5*c* the course of the unlatching stroke of the shift key.

Figure 2A:
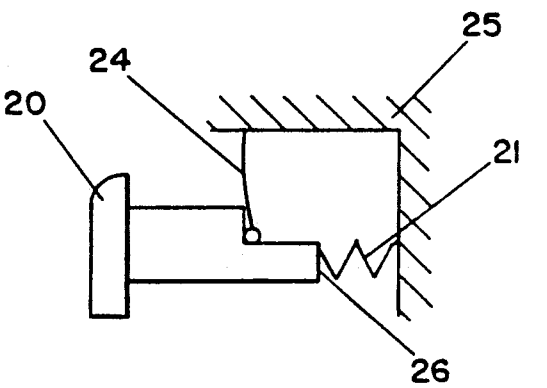
FIGS. 2*a–c* are detail views illustrating operating of a first form of component parts of the fastener of FIG. 1, FIGS. 3*a–c* are detail views similar to FIGS. 2*a–c* but of a second form.
Figure 2B:
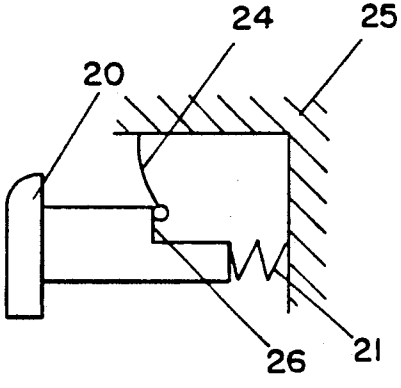
Figure 2C:
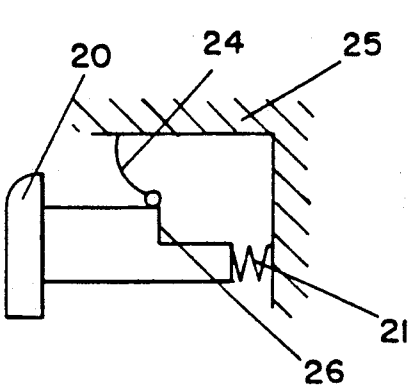

In the embodiment illustrated in FIGS. 2*a* to 2*c* an additional spring 24 which is a leaf spring is fastened to the housing 25, in substantially perpendicular alignment to the shift key 20. This plate spring 24 has its free end, rounded in spherical form, resting against a shoulder 26 of the shift key 20 and is prestressed against the insertion direction for the shift key 20. The dimension or formation of the shoulder 26 of the shift key 20 is selected in this connection in such a way that during the relative movement between the shift key 20 and the housing 25 the sliding path followed by the free end of the spring 24 over the shoulder 26 corresponds to the idle stroke 22, so that, as can be seen from FIG. 2*c*, at the beginning of the unlatching stroke 23 the free end of the additional spring 24 has come free from the shoulder 26 of the shift key 20 and no longer restrains the insertion movement of the shift key 20. In this way it is assured that during the unlatching stroke no spring action restraining motion of the shift key 20 emanates from the additional spring 24 on to the shift key 20.

Figure 3A:
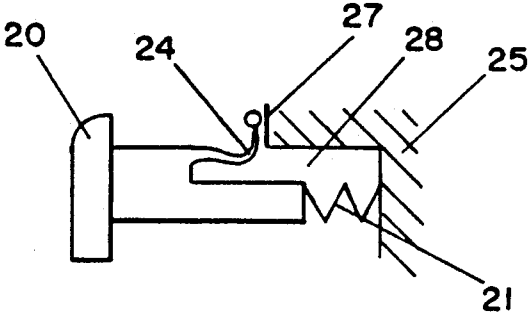
Figure 3B:
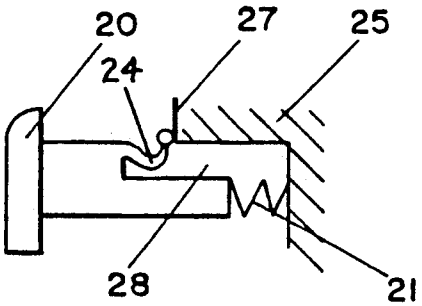
Figure 3C:
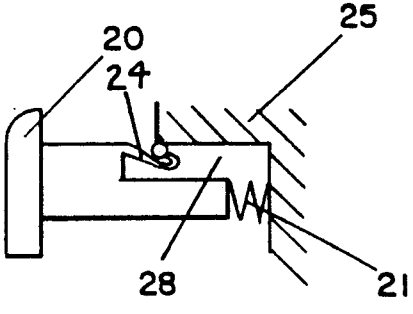

In FIGS. 3*a* to *c* an alternative embodiment is illustrated in which the additional spring 24 is arranged on the shift key 20. The additional spring 24 is supported by a shoulder 27 of the housing 25 in such a way that the spring 24 is bent forwards in the insertion direction of the shift key 20 in such a way that, during the relative movement between the shift key 20 and the housing 25 during insertion of the shift key 20, the spring 24 bends round until it loses the support of the shoulder 27 of the housing 25 and is inserted in bent-together state into the intermediate space 28 that exists between the shift key 20 and the housing 25.

In FIGS. 4*a* to 4*c* and 5*a* to 5*c* the support of the additional spring takes place on the latch 8, whereby a movement of the shift key 20 relative to the latch 18 is set in the same manner as to the housing 25 of the fastener 10.

Figure 4C:
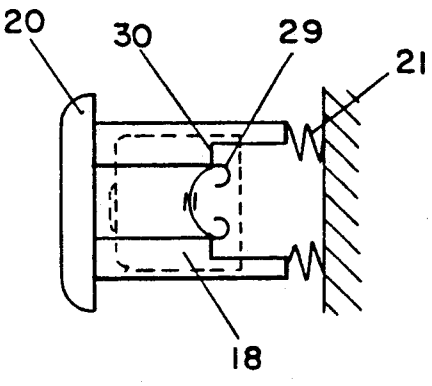
FIGS. 4*a–c* are detail views similar to FIGS. 2*a–c* but of a third form.
Figure 4B:
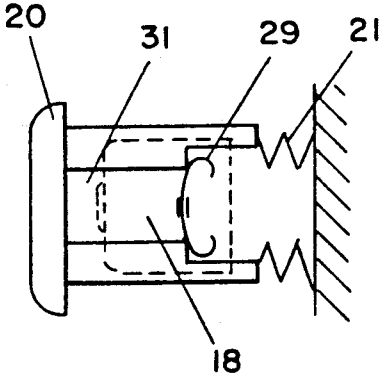
Figure 4A:
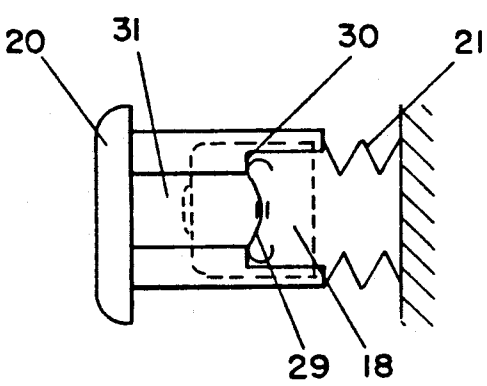

In the embodiment shown in FIGS. 4*a* to 4*c* and referring first to FIG. 4*a*, a leaf spring 29 is held centrally on the latch 18, the leaf spring 29 being arranged at right angles to the movement direction of the shift key 20. The plate spring 29 is supported with its two free ends on two shoulders 30, constructed sidewards on the U-shaped shift key 20, which shoulders enclose between them a channel 31, into which the spring 29 can be inserted during the relative movement between the shift key 20 and the latch 18 with the bending-together of the two outer legs of the spring 29. It is also clearly recognizable here that at the beginning of the unlatching stroke (FIG. 4*c*) the spring 29 no longer has any support on the shift key 20 and accordingly can no longer apply any spring force restraining insertion movement of the shift key 20.

Figure 5C:
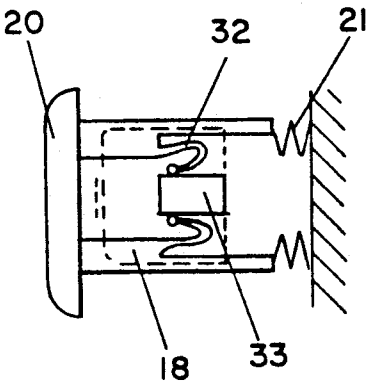
FIGS. 5*a–c* are detail views similar to FIGS. 2*a–c* but of a fourth form of the component parts.
Figure 5B:
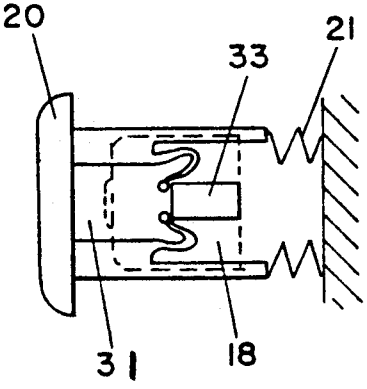
Figure 5A:
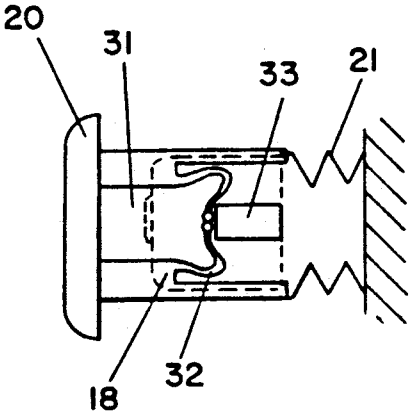

Alternatively, according to FIGS. 5*a* to 5*c* it can also be provided that the additional spring is provided in the form of two external additional spring portions 32 that are arranged on the shift key 20 constructed in a U-shaped manner, the two additional spring portions being bent inwardly towards one another and between them enclosing a projection 33 molded on the latch 18 and being supported on this, whereby during the relative movement between the shift key 20 and the latch 18 the projection 33 enters into the channel 31 formed between the two spring portions 32. In this connection, as shown in FIG. 5*c*, the inwardly-bent additional spring portions 32 likewise lose their support on the latch 18 and therefore become inactive to restrain the shift key motion when the unlatching stroke begins With a safety belt fastener constructed as described above, if an acceleration force acting in the direction of the arrow 34 (FIG. 1) results, for example as a consequence of a tightening movement in the belt system, then at the end of the tightening process when the fastener body 10 stops the mass inertia of the shift key 20 has the result that the shift key 20 continues its movement and displaces itself in this way relative to the fastener body 10. In this way due to this mass inertia an insertion movement of the shift key 20 into the fastener 10 results, whereby after passing through the idle stroke the shift key 20 carries out the unlatching stroke 23 and thus unlatches the lock. With the arrangement of the additional springs 24 or 29 or 32 according to the invention a force directed against the insertion movement is supplied to the shift key 20 already during the idle stroke from the beginning of the insertion movement such that the mass inertia of the shift key during a shock-released acceleration is also not sufficient to enter into the safety belt fastener 10 against the force of the additional spring and the shift-key spring.

As can be seen in detail from the FIGS., during the idle stroke 22 the force of the additional springs 24 or 29 or 32 as well as the force of the pressure spring 21 acts such that during the idle stroke the two spring forces add together and thus counteract the insertion movement of the shift key 20 released by the mass inertia of the shift key 20 in the case of acceleration, and prevent a movement of the shift key relative to the fastener 10. During the unlatching stroke the force of the additional springs 24 or 29 or 32 is no longer active for restraining the shift key insertion movement as these springs are no longer supported, with the result that in this respect only the normal lock opening forces are applied which are composed of the actuation force necessary for overcoming the force of the pressure spring 21 and for the movement of the latch 18.

So that this level of the lock opening forces is not increased by the provision of the additional springs, the additional springs are laid out in such a way that their spring force in conjunction with the force of the shift-key spring 21 does not exceed the unlatching forces active in the unlatching stroke.

In this connection, the exemplary embodiments of a double-sided construction of the additional springs 29 and 32 shown in FIGS. 4*a*, 4*b* and 4*c* and 5*a*, 5*b* and 5*c* are particularly advantageous because in this way no additional normal forces are introduced into the guide of the shift key 20, or in a similar way support loads are applied on to the latch 18 so that these lock functions in this respect take place without additional force loading.

The present invention is, of course, in no way restricted to the specific disclosure of the specification, examples and drawings, but also encompasses any modifications within the scope of the appended claims.

What we claims is:

1. In a safety belt fastener, for receiving and latching an insertion tongue, comprising a housing and an insertion path for said insertion tongue, said insertion path being arranged in said housing and being equipped with a spring-loaded ejector, a latch means being guided in said safety belt fastener for cooperation with a recess in said insertion tongue to achieve latching, with said latch means holding said insertion tongue in an associated further recess of said safety belt fastener, and a shift key, loaded by a spring and guided perpendicular to a plane of movement of said latch means, for unlatching said latching means, with a movement of said shift key in an insertion direction of said insertion tongue being composed of an unlatching stroke, preceded by an idle stroke in said insertion direction, the improvement wherein:

a resilient means is provided in addition to said spring of said shift key, with said resilient means being disposed between a part of said safety belt fastener and said shift key such that said resilient means is fixedly connected with one portion thereof to one of said part of said safety belt fastener and said shift key, whereby at least one free end thereof abuts the other of said part of said safety belt fastener and said shift key, with a spring force of said resilient means during said idle stroke of said shift key acting against said movement of said shift key in said insertion direction, while during said unlatching stroke said at least one free end does not abut the other of said part of said safety belt fastener and said shift key so that said resilient means is in an unloaded state.

2. A safety belt fastener according to claim 1, wherein said resilient means is an additional spring.

3. A safety belt fastener according to claim 2, wherein said additional spring is prestressed against said insertion direction of said shift key.

4. A safety belt fastener according to claim 2, wherein limitation of a spring action of said additional spring so as to resist said movement of said shift key in said insertion direction only during said idle stroke of said shift key is realized by means of a respective shape of associated abutments, provided at said shift key and said part of said safety belt, for said additional spring.

5. A safety belt fastener according to claim 2, wherein limitation of a spring action of said additional spring so as to resist said movement of said shift key in said insertion direction only during said idle stroke of said shift key is realized by means of a respective shape of associated abutments, provided at said shift key or said part of said safety belt, for said additional spring.

6. A safety belt fastener according to claim 2, wherein said additional spring is a leaf spring that is connected to said housing of said safety belt fastener and rests with a free end thereof loosely against an abutment of said shift key, with said leaf spring sliding over said abutment during said unlatching stroke of said shift key whereby a support path supplied by said abutment for said additional spring corresponds to said idle stroke of said shift key.

7. A safety belt fastener according to claim 2, wherein said additional spring is a leaf spring that is an integral part of said shift key and is supported on an associated abutment of said housing, with said leaf spring being bent forwards against said movement of said shift key in said insertion direction such that when said unlatching stroke of said shift key commences said additional spring moves into an intermediate space between said shift key and said housing.

8. A safety belt fastener according to claim 2, wherein said additional spring is held on said latch means of said safety belt fastener and is supported against at least one abutment provided on said shift key, whereby said additional spring, when said unlatching stroke of said shift key commences and support against said abutment is eliminated, deforms during further movement of said shift key relative to said latch means and enters into a recessed portion provided in said shift key.

9. A safety belt fastener according to claim 2, wherein said additional spring is provided on said shift key in the form of two spring portions bent inwardly towards one another, with said two springs enclosing between them an abutment provided on said latch means, whereby, during a relative movement between said shift key and said latch means, said two spring portions slide on said abutment with mutual deformation until support for said two spring portions provided by said abutment is eliminated.

10. A safety belt fastener according to claim 2, wherein a free end of said additional spring is constructed in a rounded manner to facilitate sliding.

11. A safety belt fastener according to claim 1, wherein said resilient means is connected to said part of said safety belt fastener and abuts said shift key.

12. A safety belt fastener according to claim 1, wherein said resilient means is connected to said shift key and abuts said part of said safety belt fastener.

* * * * *